United States Patent [19]

Izuha et al.

[11] 4,412,810

[45] Nov. 1, 1983

[54] PULVERIZED COAL BURNER

[75] Inventors: Akira Izuha, Koganei; Tomoyuki Shinano, Yokohama; Yuho Shibayama, Chiba; Chikatoshi Kurata, Akashi; Kenichi Fujii, Kobe, all of Japan

[73] Assignee: Kawasaki Jukogyo Kabushiki Kaisha, Kobe, Japan

[21] Appl. No.: 240,347

[22] Filed: Mar. 4, 1981

[51] Int. Cl.[3] ..... F23C 5/06

[52] U.S. Cl. ..... 431/186; 110/261; 431/187

[58] Field of Search ..... 431/10, 186, 187, 188, 431/284; 110/261, 262, 263, 264, 265

[56] References Cited

U.S. PATENT DOCUMENTS

| | | | |
|---|---|---|---|
| 1,412,023 | 4/1922 | Erickson | 431/186 |
| 1,661,031 | 2/1928 | Butcher | 110/261 |
| 1,779,647 | 10/1930 | Van Brunt | 431/186 |
| 1,799,459 | 4/1931 | Fantz | 431/187 |
| 2,190,190 | 2/1940 | Peterson | 431/186 |
| 2,284,708 | 6/1942 | Woolley | 110/261 |
| 2,359,049 | 9/1944 | Nagel | 431/188 |
| 2,380,463 | 7/1945 | Poole | 431/186 |
| 2,485,656 | 10/1949 | Raskin | 431/187 |
| 3,153,438 | 10/1964 | Brzozowski | 431/186 |
| 3,299,841 | 1/1967 | Hemker | 110/262 |
| 3,342,242 | 9/1967 | Verloop | 431/186 |
| 3,663,153 | 5/1972 | Bagge | 431/187 |
| 3,934,522 | 1/1976 | Booker | 431/186 |
| 4,050,879 | 9/1977 | Takahashi | 431/186 |
| 4,206,712 | 6/1980 | Vatsky | 431/284 |
| 4,333,405 | 6/1982 | Michelfelder | 110/265 |

*Primary Examiner*—Daniel J. O'Connor
*Attorney, Agent, or Firm*—Jordan and Hamburg

[57] ABSTRACT

A pulverized coal burner including a primary throat having at its forward end a swirler for feeding pulverized coal and primary air in vortical flow, a secondary throat located outside the primary throat for supplying secondary air and a burner throat located outside the secondary throat for supplying tertiary air, the secondary and burner throats being located concentrically with the primary throat having at its forward end a flame sustaining plate diverging outwardly to cause the secondary and tertiary air to flow away from the primary throat along the inner surface of the outwardly diverging forward end portion of the burner throat, to thereby avoid mixing of the secondary and tertiary air with the pulverized coal air in a primary flame region in which the pulverized coal burns slowly and produces NOx in reduced amount. The secondary throat can be moved to adjust the spacing between its forward end and the flame sustaining plate, to adjust the amount of the secondary air and the flow of the secondary and tertiary air. Unburned components of pulverized coal from the primary flame region can be mixed with the secondary and tertiary air in a secondary flame region downstream of the primary flame region and burned at a slow speed at low temperature to reduce the amounts of NOx produced.

2 Claims, 4 Drawing Figures

PULVERIZED COAL BURNER

BACKGROUND OF THE INVENTION

This invention relates to a pulverized coal burner capable of carrying out combustion in a stable state with a reduction in the amounts of NOx, CO and unburned carbon produced as the result of combustion.

A pulverized coal burner of the type shown in FIG. 1 is known as producing NOx in reduced amounts, which comprises a pulverized coal swirler 2 located within a primary throat 1 concentrically therewith at the forward end thereof, a secondary throat 3 located outside the primary throat 1 concentrically therewith, and a burner throat 4 located outside the secondary throat 3 concentrically therewith.

The pulverised coal burner of the aforesaid construction producing reduced amounts of NOx operates such that pulverized coal is carried by primary air through the primary throat 1 and swirled by the swirler 2 at the forward end of the primary throat 1 to pass in vortical flow, before being blown into a furnace. Meanwhile secondary air is ejected through the secondary throat 3 into the furnace without being swirled, and tertiary air is ejected through the burner throat 4 into the furnace without being swirled. The pulverized coal blown into the furnace after being caused to flow in vortical form by the swirler 2 is ignited and burns in the presence of the primary air and produces a primary flame 5. Unburned components of the pulverized coal burn in the presence of the secondary and tertiary air ejected through the secondary throat 3 and burner throat 4 respectively into the furnace, to form a secondary flame 6. The primary air, secondary air and tertiary air are distinct from one another in amount, and when their amounts are added together, the total is equal to the amount of air necessary for burning the pulverized coal in complete combustion. In practice, the primary air and pulverized coal are caused to pass in vortical flow by the swirler 2 so that they quickly mix with the secondary air and tertiary air and combustion takes place at once. Thus the amounts of NOx produced as the result of combustion show no marked reduction.

On the other hand, in a pulverized burner of the construction in which quick mixing of the primary air and pulverized coal with the secondary and tertiary air is avoided by reducing the speed at which the primary air and pulverized coal are swirled, a marked reduction could be obtained in the amounts of NOx produced but the flame formed in the furnace could not be sustained and stability of combustion would be lost, resulting in an increase in the amounts of CO and unburned carbon produced.

SUMMARY OF THE INVENTION

This invention has been developed for the purpose of obviating the aforesaid problems of the prior art. Accordingly, the invention has as its object the provision of a pulverized coal burner which is capable of carrying out combustion in a stable state with a flame being kept in existence throughout the period of combustion while the amounts of NOx, CO and unburned carbon produced are markedly reduced.

The outstanding characteristics of the invention are that an outwardly diverging flame sustaining plate is attached to the forward end of the primary throat in a manner to surround the swirler, the secondary throat located outside the primary throat concentrically therewith is movable backwardly and forwardly to adjust the spacing between the flame sustaining plate and the forward and of the secondary throat, and the burner throat located outside the secondary throat concentrically therewith is diverging outwardly at its forward end portion to serve as a diffuser.

Additional and other objects, features and advantages of the invention will become apparent from the description set forth hereinafter when considered in conjunction with the accompanying drawings.

DESCRIPTION OF THE PREFERRED EMBODIMENT

Figure 1:
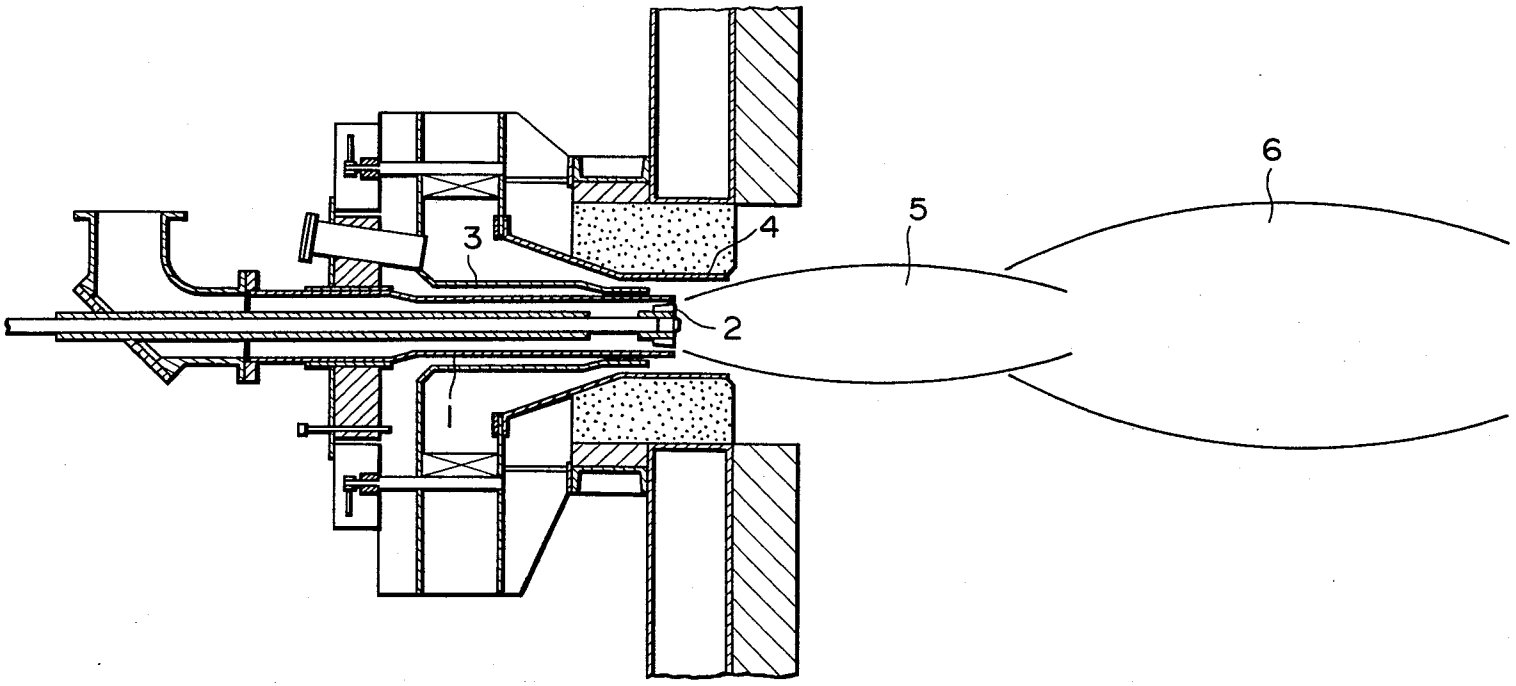
FIG. 1 PRIOR ART
FIG. 1 is a vertical sectional view of a pulverized coal burner of the prior art.

The pulverized coal burner according to the invention will now be described by referring to the embodiment shown in the drawings.

Figure 2:
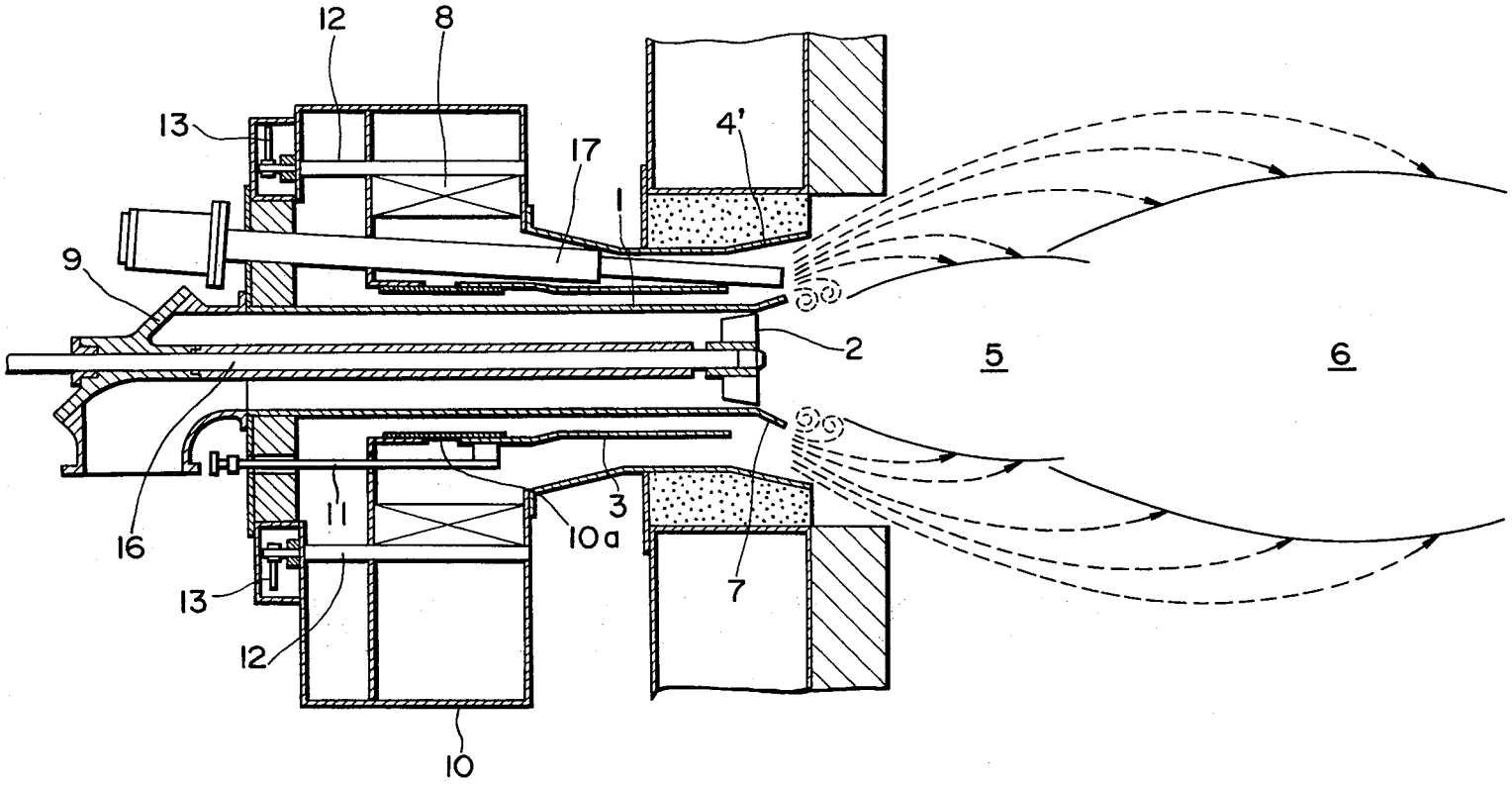
FIG. 2 is a vertical sectional view of the pulverized coal burner according to the invention.
Figure 3:
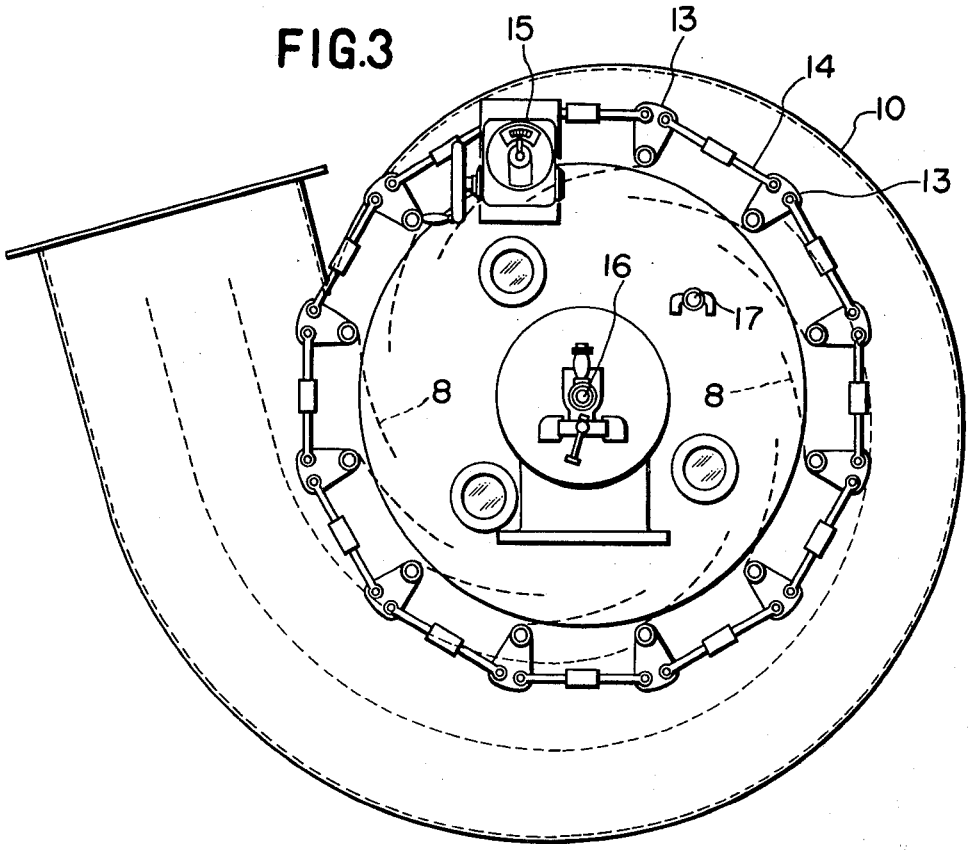
FIG. 3 is a side view of the pulverized coal burner according to the invention shown in FIG. 1.

In FIGS. 2 and 3, the numeral 1 designates a primary throat for feeding pulverized coal and primary air into a furnace which has at its forward end a pulverized coal scattering swirler 2 located within the primary throat 1 concentrically therewith. The primary throat 1 is provided with a bend 9 at its rear end and connected to a pulverized coal storage tank and a primary air source, not shown.

Figure 4:
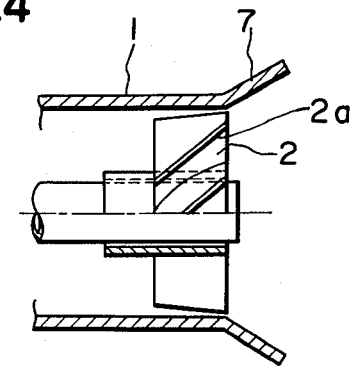
FIG. 4 is a fragmentary vertical sectional view of the swirler for scattering pulverized coal.

A flame sustaining plate 7 which is diverging outwardly as shown in FIG. 4 is located at the forward end of the primary throat 1.

The swirler 2 of the conventional pulverized coal burner shown in FIG. 1 has fixed blades inclined with respect to the longitudinal axis of the primary throat 1 by a large angle (35–60 degrees) so as to scatter the pulverized coal far and wide to obtain good combustion and sustain the flame through the entire period of combustion. As a result, the pulverized coal in the primary air quickly mixed with the secondary and tertiary air and combustion took place also quickly, so that the amount of NOx produced increased. To obviate this disadvantage attempts were made to reduce the angle at which the blades of the swirler are inclined. However, no satisfactory results were obtained because good scattering of the pulverized coal was unobtainable and complete combustion of the pulverized coal did not take place in a secondary flame zone 6.

In the present invention, the angle of the blades **2*a* of the swirler 2 is set at a value in the range between 25 and 35 degrees to cause the pulverized coal to burn homogeneously at low temperature at low speed without scattering same too far and wide, so that the pulverized coal can be distributed optimally in the secondary flame region 6 to burn therein while the amounts of NOx produced are reduced. A secondary throat 3 located outside the primary throat 1 concentrically therewith for supplying secondary air is movably supported by a guide wall 10*a* of a vortex casing 10 and is connected with an adjusting means 11. The secondary throat 3 is moved backwardly and forwardly by the adjusting means 11** and the spacing between the flame sustaining plate 7 and the forward end of the secondary throat 3 is adjusted. A burner throat 4' for supplying tertiary air in the form of a diffuser is located outside the secondary throat 3 and diverges outwardly at its forward end portion. The secondary throat 3 and burner throat 4' are connected at their rear ends to an air source, not shown, through the vortex casing 10 in the embodiment shown. Numbers of blades 8 are fixed to shafts 12 respectively. Each shaft 12 is supported rotatably by the casing 10 and is connected to each arm 13. The adjacent arms 13 are connected with each other by a connecting rod 14, which is adjustable in length. One of the connecting rods 14 or one of the arms 13 is connected with a means 15 for adjusting the opening degree of the blades 8 by moving the connecting rods 14 or the arms 13. The blades 8 cause tertiary air supplied through the vortex casing 10 and ejected through the burner throat 4' to flow in vortical form. The blades 8 are in suitable number and arranged on a rotor circumferentially thereof to convert the tertiary air supplied through the vortex casing 10 to a vortical flow. The tertiary air in vortical flow is ejected through the burner throat 4'.

In the pulverized coal burner of the aforesaid construction according to the invention, the pulverized coal is transported by the primary air flowing through the primary throat 1 and caused to flow in vortical form a low speed by the swirler 2 when it is ejected into the furnace. Since the blades of the swirler 2 are inclined by a small angle which is in the range between 25 and 35 degrees, the pulverized coal is not scattered too far and wide. Meanwhile the secondary and tertiary air is prevented from mixing too quickly with the primary air transporting the pulverized coal because the flame sustaining plate 7 diverges outwardly and has the effect of directing the secondary and tertiary air outwardly away from the primary throat 1. Thus the pulverized coal is allowed to burn slowly at low temperature in the presence of the primary air, to form a primary flame 5 at the primary throat 1. The primary flame 5 has marked paucity of $O_2$ and therefore the NOx produced in the primary flame 5 is very small in amount. The primary flame 5 is produced primarily by the combustion at low temperature of volatile components of the pulverized coal which is markedly lacking in $O_2$, so that char and unburned components (hydrocarbons, $NH_3$, HCN and CO) tending to cause a denitration reaction to take place are produced and react with NOx. Thus the NOx is ultimately deoxidized to $N_2$. The secondary and tertiary air caused to flow outwardly away from the primary throat 1 by the outwardly diverging flame sustaining plate 7 is guided by the inner surface of the outwardly diverging forward end portion of the burner throat 4' of the diffuser type and flows smoothly. The secondary and tertiary air flowing in this way engulfs near the tip of the primary flame 5 substantial amounts of char produced in the flame 5, so that the char is burned slowly at low speed to form a secondary flame 6. Combustion of the char at low speed at low temperature in the secondary flame 6 produces NOx. However, the aforesaid unburned components are also produced and spread widely in the furnace, to stay there for a prolonged period. Thus deoxidation of the NOx is promoted by the presence of the unburned components, so that the concentration of the unburned components is reduced as combustion of the unburned components takes place slowly with a reduction in the concentration of NOx.

In the invention, the secondary throat 3 is movable backwardly and forwardly so that the spacing between the forward end of the secondary throat 3 and the flame sustaining plate 7 can be adjusted. By moving the secondary throat 3 backwardly and forwardly in burning pulverized coal, the amount of secondary air ejected through the secondary throat 3 can be reduced or increased and at the same time the flow of the secondary and tertiary air can be varied. Thus combustion of the char in the secondary flame 6 can be effected in optimum condition from the points of view of reducing the amounts NOx and increasing the efficiency of combustion.

From the foregoing, it will be appreciated that the arrangement whereby the angle of the blades of the swirler 2 is set at a value in the range between 25 and 35 degrees allows the pulverized coal blown by the primary air through the primary throat into the furnace to be scattered in a small area and burn slowly at low temperature in a state of paucity of $O_2$, thereby reducing the amounts of NOx produced. The flame sustaining plate 7 has the effect of keeping the flames 5 and 6 in existence throughout the period of combustion.

The arrangement whereby the outwardly diverging flame sustaining plate 7 is located at the forward end of the primary throat 1 and the burner throat 4' is in the form of a diffuser causes the secondary and tertiary air ejected from the secondary throat 3 and burner throat 4 respectively to flow outwardly away from the primary throat 1 along the inner surface of the forward end portion of the burner throat 4' to a region beyond the tip of the primary flame 5. Thus mixing of the secondary and tertiary air with the pulverized coal in the region of primary flame 5 is inhibited, so that the pulverized coal burns at low speed at low temperature in a state of paucity of $O_2$ and production of NOx in the primary flame 5 as the result of combustion of the pulverized coal is inhibited. The provision of the flame sustaining plate 7 permits the flames 5 and 6 to be kept in existance throughout the period of combustion. The secondary and tertiary air engulfs substantial amounts of char in a position downstream of the tip of the primary flame 5, to burn the char at low speed. Thus production of NOx in the secondary flame 6 is also inhibited. The pulverized coal is suitably scattered in the region of secondary flame 6 due to the spinning action of the swirler 2, and burns in the presence of the secondary and tertiary air in a wide region. Thus the burner can carry out combustion with a high degree of efficiency and the amounts of CO and unburned carbon produced are markedly reduced.

The arrangement whereby the secondary throat 3 can be moved backwardly and forwardly enables the amounts of the secondary air and the flow of the secondary and tertiary air to be controlled as desired, to thereby permit combustion of the char and the secondary and tertiary air in the secondary flame 6 to take place in optimum condition from the points of view of reducing the amount of NOx produced and increasing the efficiency of combustion. Thus the pulverized coal burner according to the invention is capable of achieving the excellent effects of enabling the pulverized coal to burn in a stable state with a high degree of efficiency while reducing the amounts of NOx produced and producing CO and unburned carbon in reduced amounts.

For the initial burning operation of the present burner an oil burner 16 can be desirably arranged in the first throat 1 and elongated through the bend 9. The oil burner 16 is ignited by the igniter 17 arranged between the secondary throat 3 and the burner throat 4' and elongated through the casing 10.

The pulverized coal and the primary air are ignited by the oil burner 16 at the first time of the burning operation. After the ignition of the pulverized coal burner the operation of the oil burner is stopped.

What is claimed is:

1. A pulverized coal burner adapted to reduce undesired combustion waste gas, comprising:

a primary throat for supplying pulverized coal and primary air to a furnace, a flame sustaining plate located at the forward end of said primary throat and diverging outwardly therefrom so that the primary air and the pulverized coal are ejected at a relatively low speed from the primary throat to burn in the furnace at a low temperature for producing char and unburned components thereat, a secondary throat located outside said primary throat concentrically therewith for supplying secondary air to the furnace, said secondary throat being movable back and further to adjust the spacing thereof relative to the flame sustaining plate for adjusting the rate of supply of the secondary air through the secondary throat into the furnace, and a burner throat located outside said secondary throat concentrically therewith for supplying tertiary air to the furnace, said burner throat diverging outwardly at the forward end thereof to form a diffuser so that the tertiary air is directed together with the secondary air to diverge outwardly without substantially mixing with the primary air and the pulverized coal, whereby the secondary air and the tertiary air burn at a low temperature with the char and unburned components previously burned in the furnace.

2. A pulverized coal burner according to claim 1, in which said primary throat further includes a swirler at the forward end thereof, said swirler being located concentrically within the primary throat and having fixed blades inclined with respect to the longitudinal axis of the primary throat at an angle in the range of 25 to 35 degrees.

* * * * *